United States Patent [19]

Dabney

[11] 4,212,494

[45] Jul. 15, 1980

[54] ROCKER RECLINING CHAIR WITH MULTI-POSITION ROCKER LOCK

[75] Inventor: Upton Dabney, Morristown, Tenn.

[73] Assignee: Kroehler Mfg. Co., Naperville, Ill.

[21] Appl. No.: 927,408

[22] Filed: Jul. 24, 1978

[51] Int. Cl.[2] ..... A47C 1/02

[52] U.S. Cl. ..... 297/69; 297/DIG. 7; 297/84

[58] Field of Search ..... 297/317, DIG. 7, 270, 297/271, 83, 84, 69

[56] References Cited

U.S. PATENT DOCUMENTS

| | | | |
|---|---|---|---|
| 3,096,121 | 7/1963 | Knabusch et al. | 297/DIG. 7 |
| 3,287,059 | 11/1966 | Rosmarin | 297/271 |
| 3,339,971 | 9/1967 | Fletcher | 297/271 |
| 3,475,051 | 10/1969 | Crawford | 297/271 X |
| 3,638,995 | 2/1972 | Flanagan | 297/317 X |
| 3,730,585 | 5/1973 | Rogers, Jr. et al. | 297/270 |
| 3,768,859 | 10/1973 | Rogers, Jr. et al. | 297/DIG. 7 |
| 3,848,924 | 11/1974 | Shoemaker et al. | 297/271 X |
| 3,869,169 | 3/1975 | Johnson et al. | 297/69 X |
| 4,113,305 | 9/1978 | Hampton | 297/69 |

*Primary Examiner*—James T. McCall

*Attorney, Agent, or Firm*—Arnstein, Gluck, Weitzenfeld & Minow

[57] ABSTRACT

A rocker reclining chair has a base, a rocking frame mounted on the base for rocking movement, a seat frame suspended by linkage from the rocking frame for movement between a lower position and a forwardly raised position, a backrest connected by linkage to the seat frame to pivot relative thereto between normal upright and reclined position, the backrest linkage serving to actuate the seat frame to swing the seat frame upwardly and forwardly when the backrest is moved into reclining positions, and a footrest with the linkage mounting it to the seat frame to be operable by a handle between a retracted position and an extended position. A locking mechanism is provided between the base and the rocking frame and is operative to lock the rocking frame in one of a variety of positions within the limits of the rocking travel when the footrest is not fully retracted. A lock release means connected to the footrest linkage automatically actuates the locking mechanism to release the rocking when the footrest is fully retracted. When the backrest is moved to reclining position independent of the extension of the footrest, the locking mechanism is rendered effective to lock the frame against rocking movement.

5 Claims, 7 Drawing Figures

ROCKER RECLINING CHAIR WITH MULTI-POSITION ROCKER LOCK

DESCRIPTION OF THE PRIOR ART

Heretofore, rocker reclining chairs have been limited in their operational range of the reclining feature by the rocker locking system which the user could not control. Some such chairs provide a linkage system which locks the chair in a predetermined single position. Other such chains employ various combinations of rollers and links, functional only in one direction and set to a single position. Still others of such chairs employ a ratchet and pawl device operational in only one direction and where positioning is determined by balance rather than by choice.

The present invention eliminates the foregoing limitations and enhances the use of the mechanism of the reclining chair by adding to the normal operational range of the mechanism the rocking system range of motion. This is accomplished without limiting the operational range of the reclining mechanism and is effective automatically upon the initial operation of the linkage system, thereby allowing the user to select the desired starting and final positions. The locking mechanism is positively effective in both directions and will hold the rockable substructure in a fixed position until the foot rest is fully retracted, at which time the chair is free to rock.

BRIEF DESCRIPTION OF THE DRAWINGS

FIG. 2 is an elevational view, on an enlarged scale, of the locking mechanism in disengaged position, as it appears in FIG. 1.

BRIEF DESCRIPTION OF A PREFERRED EMBODIMENT

Figure 1:
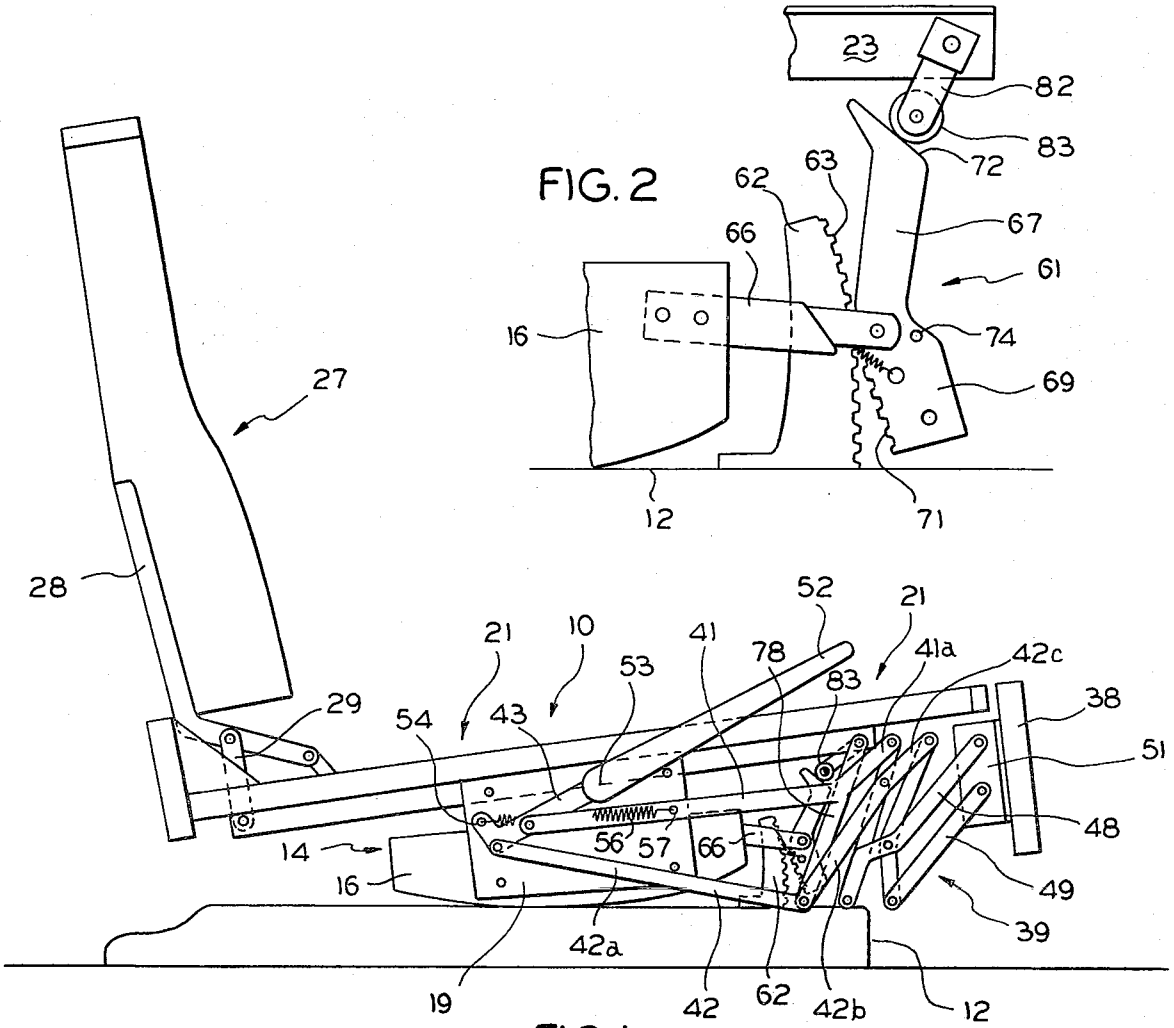
FIG. 1 is a longitudinal cross sectional view of a rocker reclining chair embodying the present invention and shown with a portion of the upholstery removed, with the foot rest linkage in retracted position and with the back rest linkage not shown.
Figure 5:
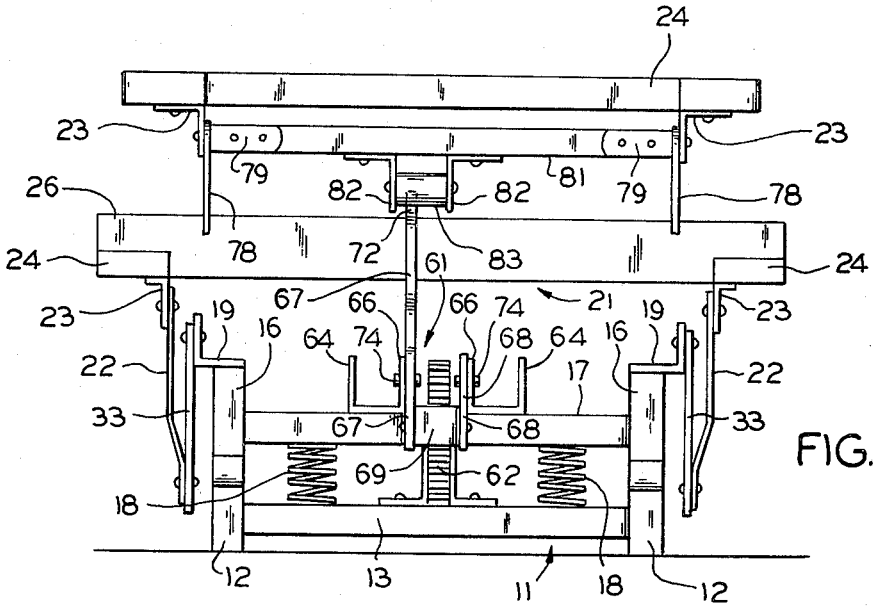
FIG. 5 is a front elevational view of the chair, showing only the locking mechanism and related components of the chair.

Referring to FIGS. 1 and 5 of the drawings there is shown a rocker-reclining chair, generally designated by the numeral 10, embodying the present invention. The chair 10 includes a base 11 comprised of opposite side members 12 extending along the underside of the chair and opposite end members 13 extending transversely under the chair between the side members 12. Mounted for rocking movement on the base, is a typical rocking frame 14 composed of a pair of arcuate rocking members 16 engaged on the base side members 12 while being interconnected by forwardly and rearwardly positioned cross members 17. A conventional compression spring assembly generally designated by the numeral 18 is provided between the rocker frame 14 and base 11 on opposite sides thereof in a typical manner.

An angle bracket 19 is supported on each of the arcuate rocking members 16 and suspended from said brackets by a linkage, hereinafter to be described, is a seat frame 21 including opposite parallel mounting plates 22 positioned in vertical planes outwardly of the rocker frame. Supported on the mounting plates 22 is a generally rectangular upholstery frame including a pair of longitudinal parallel members 23 supporting frame members 24 connected by front and rear transverse members 26. A seat cushion, not shown, is supported on the seat frame 21 in any suitable manner.

Figure 6:
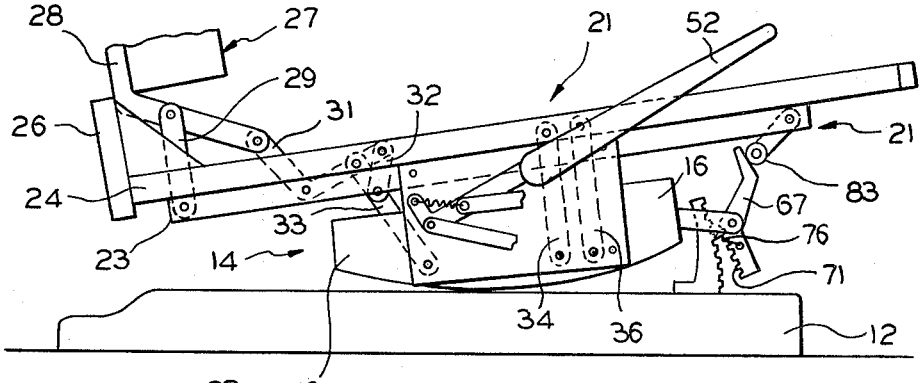
FIG. 6 is a longitudinal cross-sectional view of the rocker reclining chair showing only the back rest and seat and connecting linkage with the back rest in upright position.
Figure 7:
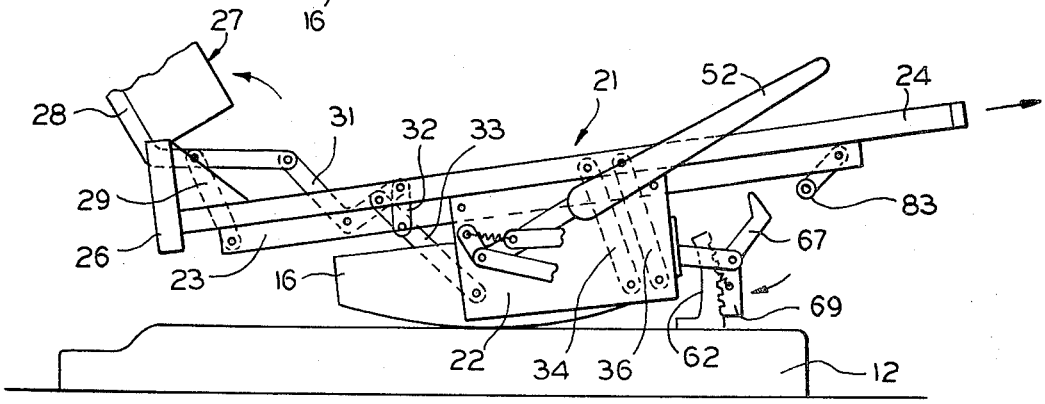
FIG. 7 is a view similar to FIG. 6 showing the back rest in reclining position.

A back rest 27 having an upholstery frame is pivotally supported on the seat frame 21 and is movable between a normal, upright position, as shown in FIG. 6, and a plurality of inclined or reclining positions, as shown in FIG. 7. The back rest 27 includes a pair of mounting members 28, shaped substantially in elevation, as illustrated in FIG. 1, to which the back rest frame is secured. A pair of short links 29 are connected each at one end to the back rest mounting members 28 and at the other end to the seat frame mounting members 23. Additionally, each of the backrest mounting members 28 is connected to one end of a crank 31 which is pivotally connected intermediate its ends to a seat frame mounting member 23. The opposite end of each crank 31 is pivotally connected to an actuating link 32 which is pivotally connected to a rear mounting link 33 which extends between the vertical flange of the angle bracket 19 and the depending portion of the mounting plate 22. A pair of forward mounting links 34,36 is connected to each vertical flange of the angle bracket 19 and to the forward lower portion of the mounting plate 22. When the backrest 27 is moved into reclining position the back rest linkage connected to the seat frame linkage, above described, will cause the seat frame 21 to swing upwardly and forwardly relative to the rocking frame 14. Actuation of the backrest 27 into reclining position is effected by the occupant exerting back pressure on the backrest. Return of the backrest 27 to normal upright position is effected by the occupant removing pressure from the backrest to permit the weight of the occupant to restore the backrest frame and the seat frame to their normal positions.

Figures 3, 4:
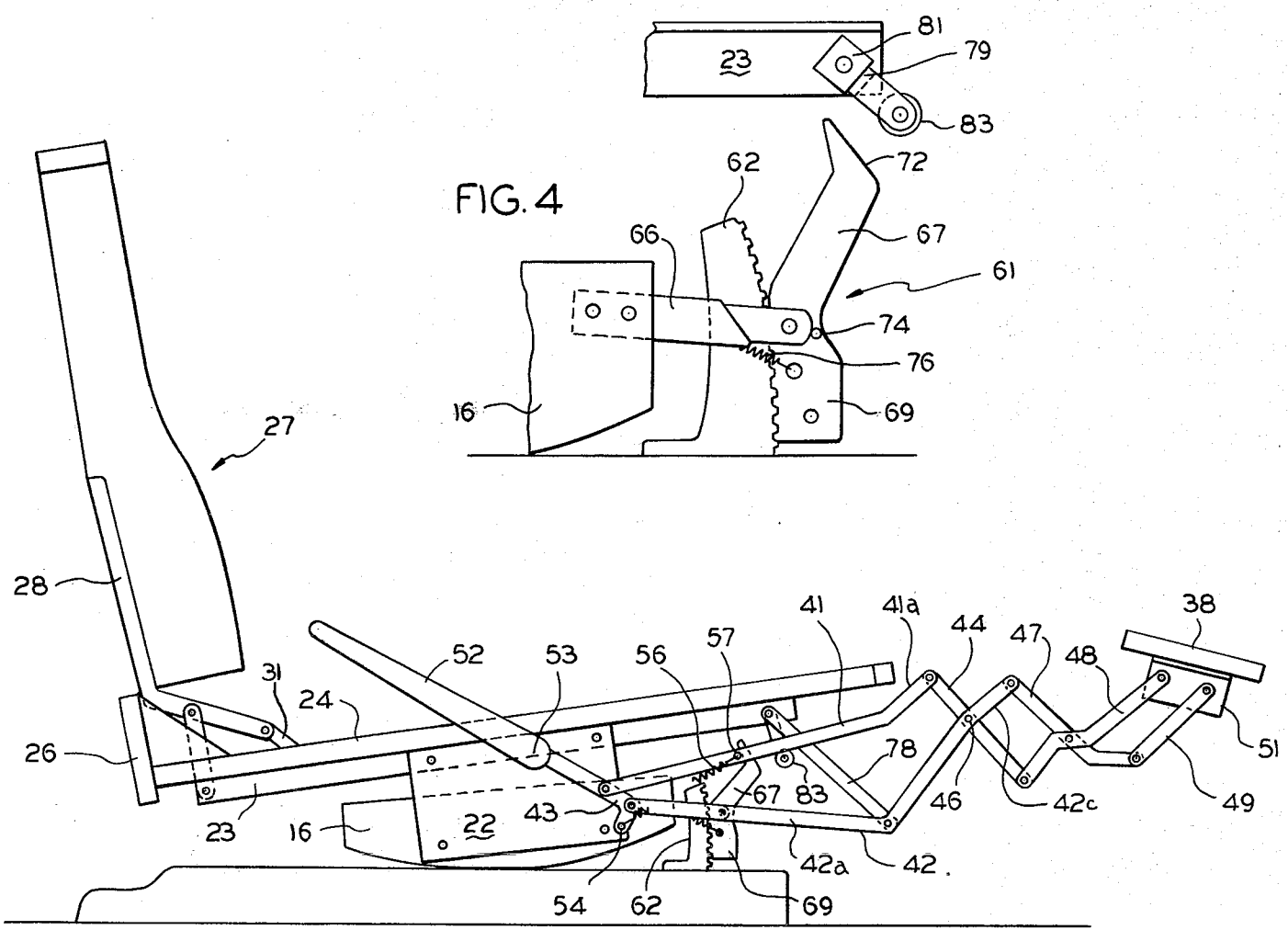
FIG. 3 is a view similar to FIG. 1, but showing the foot rest in extended position.
FIG. 4 is a view similar to FIG. 2, showing the locking mechanism in engaged position, as it would appear in FIG. 3.

At the front of the chair a footrest 38 is connected by a linkage arrangement, presently to be described, to be movable between a retracted position oriented in a substantially vertical plane, as shown in FIG. 1, and an extended position projected forwardly from the chair, as illustrated in FIG. 3.

Referring to FIGS. 1 and 3, the footrest linkage 39 on each side of the chair includes a pair of extension links 41 and 42 extending in a forwardly direction and each connected at its rearward end to a hand operated crank 43, presently to be described. The upper link 41 is generally straight for the greater part of its length and has its forward portion 41*a* extending upwardly at a slight angle. The lower link 42 has a first generally straight portion 42*a*, a second integral portion 42*b* extending upwardly and an integral third portion 42*c* extending slightly downwardly from the second portion. Connected to the forward end 41*a* of the upper link 41 is a straight link 44 which is pivoted intermediate its ends to the lower link 42, as at 46. Connected to the forward end 42*c* of the lower link 42 is a link 47 having a generally straight portion and an end portion in angular relation thereto. Connected to the lower end of the straight link 44 is a link 48, generally Z-shaped, substantially as illustrated. A straight link 49 is connected to one end of link 47. The free ends of the links 48 and 49 are connected to a bracket 51 which is connected to the inner side of the footrest 38.

Actuation of the footrest linkage 39 to extend and retract the footrest 38 is achieved through a handle 52 mounted on a shaft journalled, as at 53, on a pin extending outwardly of the mounting plate 19.

The handle shaft is rigidly connected to a laterally extending flange portion of the crank 43 to which the rearward ends of the extension links 41 and 42 are pivotally connected. The crank 43 includes an integral offset portion carrying a lateral pin 54 to which is connected one end of a tension coil spring 56, the other end of the spring being connected to a pin 57 fixed on an intermediate portion of the extension link 41. The spring biases the footrest 38 in both extended and retracted positions.

It is noted at this point that the backrest linkage is independent from the footrest linkage.

LOCK MECHANISM TO PREVENT ROCKING MOVEMENT

In order to prevent rocking movement of the chair when the footrest 38 is in extended position, or when the backrest 27 is in reclining position, and also to adjust the inclination of the chair to a desired position, locking mechanism, generally indicated by the numeral 61 is provided at the lower forward portion of the chair. The locking mechanism 61 includes a keeper member 62 fixed to the front cross member 13 of the base, substantially medially thereof, and having a forwardly directed arcuate face provided with a series of teeth 63 similar to a gear segment. The locking mechanism includes a forked bracket 64 mounted on cross member 17 of the rocker frame and provided with upstanding flanges 66 defining a space therebetween. A pair of parallel arms 67,68 are pivotally secured to flanges 66 and fixed to the lower ends of said arms is a block 69 having a series of teeth 71 complementary to and in confronting relation to the teeth 63 of the keeper member 62. As will be seen clearly in FIG. 5, the block 69 is disposed in registration with the keeper 62 so that the respective teeth of the keeper and the block may interengage. One of the parallel arms 67 extends upwardly and terminates in a camming portion 72, as seen clearly in FIGS. 2 and 4. Each of the arms 67,68 is provided with a laterally extending pin 74 which is adapted to engage a respective flange of the bracket 66 and to serve as a stop to limit the movement of the block 69 in relation to the keeper 62. A pair of springs 76 are provided each connected to a respective arm 67, 68 and to a respective flange of the bracket 66, the springs serving to normally bias the block 69 in the direction of the teeth of the keeper 62, as viewed in FIG. 4. The curvature of the face of the block 69 carrying the teeth 71 is concentric with and complementary to the curvature of the face of the keeper 62 so that a plurality of teeth of the keeper and the lock will normally be in engagement when locking is effected.

Referring to FIGS. 3,4 and 5, a pair of parallel links 78 are pivotally supported at the forward ends of the seat frame mounting member 23. Each link 78 includes a latteral flange 79 and rigidly connected to each flange is a transverse bar 81 to which is fixed, medially thereof, a pair of brackets 82 supporting an actuating roller 83. As seen in FIG. 5, the roller 83 is in registration with the camming portion 72 of the arm 67 so as to engage the same, as will be hereinafter explained. The lower end of each link 78 is pivotally connected to the extension link 42 at the juncture of the first and second portions 42*a*, 42*b*. As will be apparent by reference to FIGS. 1 and 3, movement of the leg rest linkage 39 by the hand lever 52 will effect corresponding movement of the roller 83 to and from the positions illustrated in FIGS. 2 and 4. As seen in FIG. 4, the roller 83 is out of engagement with the camming portion 72 of the arm 67 and, accordingly, the teeth of the block 69 are engaged with the teeth of the keeper 62. As seen in FIG. 2 the roller 83 is engaged with the arm 67 and has rocked the block 69 out of engagement with the keeper 62 so as to permit relative movement between the block and the keeper.

OPERATION

As was hereinabove noted, the backrest linkage is independent from the footrest linkage. When the footrest 38 is retracted and the backrest 27 is in normal upright position, the backrest and footrest linkage, as well as the locking mechanism 61 assumes the position, substantially as illustrated in FIGS. 1 and 2. In this position, the arm 67 has been engaged by the roller 83 and has been rocked in a counterclockwise direction to effect separation of the teeth of the block 69 from the teeth of the keeper 62. Thus, the occupant may freely use the chair as a rocker. In order to extend the footrest 38, the hand lever 52 is manually manipulated and shifted from the position illustrated in FIG. 1 to that illustrated in FIG. 3. In such movement the cam roller 83 is rocked counterclockwise, as viewed in FIGS. 3 and 4, out of engagement with the arm 67 so as to permit the biasing springs 76 to draw the block 69 into engagement with the keeper 62 to prevent rocking movement of the chair. It will be understood, of course, that the occupant may incline the chair to a desired angle by gently pressing his feet against the floor to shift the seat to the most comfortable position and then may actuate the lever 52 to lock the seat in such position. Also, it will be understood that the block 69 will engage the keeper 62 to lock the chair against movement substantially at the point where the footrest just begins to extend forwardly from the chair. Thus, at this point the footrest still is disposed in close proximity to the seat so as not to interfere with the comfort of the occupant in sitting position. However, the chair is locked against rocking. Further rearward movement of the lever 52 will effect extension of the footrest 38 to its maximum limit, as illustrated in FIG. 3. As the link 78 is caused to move from the retracted position illustrated in FIG. 1 to the extended position illustrated in FIG. 3, the roller 83 will be caused to rock in a counterclockwise direction so as to move away from engagement with the arm 67. Thus, in the extended position of the footrest 38 the roller 83 occupies the position in relation to the arm 67, as illustrated in FIG. 4.

In order to return to normal sitting position, the occupant merely applies pressure on the footrest 38 with his legs to effect retraction of the footrest and its associated linkage to the position illustrated in FIG. 1. In such retractive movement the roller 83 is caused to swing in a clockwise direction, from the position illustrated in FIG. 4 to that illustrated in FIG. 2, to engage arm 67 and move the block 69 out of engagement with the keeper 62 so as to free the chair for rocking.

As was hereinabove noted, the backrest linkage operates independently of the leg rest linkage. When the backrest 27 is inclined rearwardly from sitting position shown in FIG. 6 to reclining position, the associated linkage moves the seat frame 21 forwardly and upwardly, as shown in FIG. 7, so that the roller 83 is moved away from engagement with the arm 67 thereby permitting the block 69 to rock into engagement with the keeper 62 to lock the seat frame in an inclined position. Such locking action is effected upon the initial upward movement of the seat frame. It will be understood that this action is independent of any movement of the footrest linkage 39 which subsequently may be extended by manipulating the hand lever 52. While the backrest and footrest linkages operate independently, either will lock the chair against rocking movement when actuated. The chair may be returned to normal rocking or sitting position by the occupant merely applying pressure with his legs on the footrest 38 and leaning forwardly so that the backrest 27 may return to its normal position.

From the above description it will be apparent that the present invention provides a novel rocker reclining chair incorporating linkage assemblies for the backrest and footrest which are independently operable to afford a wider range of adjustment than heretofore possible with conventional chairs, yet each linkage is effective to act on a locking mechanism to lock the chair in a position of adjustment.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. In a combination rocking and reclining chair including a base, a rocking frame mounted on the base for rocking movement, a seat frame, seat frame linkage means mounting said seat frame for forward and upward movement relative to said rocking frame, a backrest, backrest linkage means pivotally mounting said backrest on said seat frame for movement between a generally upright position and a reclining position, the movement of said backrest to reclining position also effecting conjoint movement of said seat frame forwardly and upwardly, a footrest movable between an extended position projected forwardly from the front of the chair and a retracted position, footrest linkage means mounting said footrest relative to said seat frame, manually operated means for actuating said footrest linkage means for selectively moving said footrest between extended and retracted positions independently of the movement of the backrest, locking means actuated by the movement of said footrest linkage to extended position for selectively locking said rocking frame in one of a plurality of angular positions and for preventing rocking movement of the rocking frame when the footrest is in extended position, said locking means also being actuable upon the forward movement of said seat frame independently of the movement of said footrest linkage means to lock said rocking frame in a selected angular position, and actuating means operated by the movement of said footrest linkage means for automatically releasing said locking means when said footrest is moved to retracted position so as to permit rocking of said rocking frame.

2. In a combination rocking and reclining chair including a base, a rocking frame mounted on the base for rocking movement, a seat frame, seat frame linkage means mounting said seat frame for forward and upward movement relative to said rocking frame, a backrest, backrest linkage means pivotally mounting said backrest on said seat frame for movement between a generally upright position and a reclining position, the movement of said backrest to reclining position also effecting conjoint movement of said seat frame forwardly and upwardly, a footrest movable between an extended position projected forwardly from the front of the chair and a retracted position, footrest linkage means mounting said footrest relative to said seat frame, manually operated means for actuating said footrest linkage means for selectively moving said footrest between extended and retracted positions independently of the movement of the backrest, locking means including a keeper supported on said base and a cooperating locking member pivotally mounted on said rocking frame and biased into locking engagement with said keeper, an actuating member pivotally supported on the seat frame and normally engageable with said locking member when the footrest is retracted and the backrest is upright to hold the locking member out of engagement with said keeper so as to permit rocking movement of said rocking frame, said locking means being actuated by the movement of said footrest linkage to extended position or the forward movement of said seat frame to selectively lock said rocking frame in one of a plurality of angular positions and prevent rocking movement of the rocking frame when the footrest is in extended position or when the backrest is in reclining position, said actuating member being moved out of engagement with the locking member when the footrest is moved to retracted position or the backrest is moved to upright position thereby to permit rocking of said rocking frame.

3. In a combination rocking and reclining chair including a base, a rocking frame mounted on the base for rocking movement, a seat frame, a seat frame linkage means mounting said seat frame for forward and upward movement relative to said rocking frame, a backrest, backrest linkage means pivotally mounting said backrest on said seat frame for movement between a generally upright position and a reclining position, the movement of said backrest to reclining position also effecting conjoint movement of said seat frame forwardly and upwardly, a footrest movable between an extended position projected forwardly from the front of the chair to a retracted position, footrest linkage means mounting said footrest relative to said seat frame, manually operated means for actuating said footrest linkage means for selectively moving said footrest between extended and retracted positions independently of the movement of the backrest, locking means including a keeper supported on the base, a cooperating locking member pivotally mounted on the rocking frame and normally biased into locking engagement with said keeper, a shaft rotatably supported at the forward end of said seat frame, an actuating member normal to and rigid with said shaft and normally engageable with said locking member when the footrest is retracted or the backrest is upright to hold the locking member out of engagement with said keeper so as to permit rocking movement of said rocking frame, said actuating member being adapted to be moved into or out of engagement with said locking member upon the rotation of said shaft, a link rigid with said shaft and pivotally connected to said footrest linkage whereby movement of said footrest linkage will rock said shaft to move said actuating member into or out of engagement with said locking member, said actuating member when engaged with said locking member effecting release of said locking member from said keeper and said actuating member when disengaged from said locking member effecting a locking action between said locking member and said keeper.

4. The invention as defined in claim 3 in which the locking member and keeper each has a series of teeth with the teeth of the locking member being interengageable with the teeth of the keeper.

5. The invention as defined in claim 3 in which the keeper includes a curved toothed rack and the locking member includes a toothed surface complementary to said rack.

* * * * *